United States Patent [19]

Iizuka

[11] Patent Number: 5,015,163

[45] Date of Patent: May 14, 1991

[54] SCROLL TYPE COMPRESSOR WITH RADIALLY OUTER SUPPORT FOR FIXED END PLATE

[75] Inventor: Jiro Iizuka, Takasaki, Japan

[73] Assignee: Sanden Corporation, Japan

[21] Appl. No.: 374,777

[22] Filed: Jul. 3, 1989

[30] Foreign Application Priority Data

Jul. 8, 1988 [JP] Japan ..... 63-169098

[51] Int. Cl.[5] ..... F04C 18/04

[52] U.S. Cl. ..... 418/55.1; 418/55.2; 29/888.022

[58] Field of Search ..... 418/55 R, 55 A, 55 B, 418/55 C, 55 D, 55 E, 83; 29/888.022

[56] References Cited

U.S. PATENT DOCUMENTS

| | | | |
|---|---|---|---|
| 3,200,752 | 8/1965 | Clark et al. | 417/300 |
| 3,560,119 | 2/1971 | Busch et al. | 418/55 B |
| 3,924,977 | 12/1975 | McCullough | 418/57 |
| 4,082,484 | 4/1978 | McCullough | 418/57 |
| 4,303,379 | 12/1981 | Hiraga et al. | 418/55 A |
| 4,304,535 | 12/1981 | Terauchi | 418/55 A |
| 4,325,683 | 4/1982 | Miyazawa | 418/55 B |
| 4,411,604 | 10/1983 | Terauchi | 418/55 R |
| 4,472,120 | 9/1984 | McCullough | 418/83 |
| 4,597,724 | 7/1986 | Sato et al. | 418/57 |
| 4,645,436 | 2/1987 | Sakamoto | 418/55 A |
| 4,744,733 | 5/1988 | Terauchi et al. | 418/55 R |

FOREIGN PATENT DOCUMENTS

| | | | |
|---|---|---|---|
| EP-A-12615 | 6/1980 | European Pat. Off. . | |
| EP-A-60496 | 9/1982 | European Pat. Off. . | |
| 57-173586 | 10/1982 | Japan | 418/55 R |
| 58-67902 | 4/1983 | Japan | 418/55 A |
| 58-133491 | 8/1983 | Japan | 418/55.2 |
| 59-176483 | 10/1984 | Japan | 418/55.2 |

*Primary Examiner*—Leonard E. Smith
*Assistant Examiner*—David L. Cavanaugh
*Attorney, Agent, or Firm*—Banner, Birch, McKie & Beckett

[57] ABSTRACT

A scroll type compressor including a fixed scroll and an orbiting scroll is disclosed. The fixed scroll includes a first circular end plate from which a first spiral wrap extends and the orbiting scroll includes a second circular end plate from which a second spiral wrap extends. The spiral wraps interfit such that an axial gap is maintained between the axial end surface of each wrap and the axial surface of the adjacent end plate, at a central location of the scrolls. The fixed end plate is supported in the compressor housing at a radially intermediate portion of the axial end surface opposite the spiral wrap, and at a radially outer portion by an annular ridge formed on the inner surface of the compressor housing.

16 Claims, 5 Drawing Sheets

SCROLL TYPE COMPRESSOR WITH RADIALLY OUTER SUPPORT FOR FIXED END PLATE

BACKGROUND OF THE INVENTION

1. Field of the Invention

This invention relates to a scroll type refrigerant compressor, and more particularly, to the positioning of a fixed scroll within the compressor housing in order to reduce metal fatigue of the housing.

2. Description of the Prior Art

Scroll type refrigerant fluid compressors are known as disclosed in U.S. Pat No. 4,597,724 to Sato et al. The compressor includes an enclosed housing in which a fixed scroll and an orbiting scroll are disposed. The fixed scroll includes a first circular end plate from which a first spiral wrap extends. The orbiting scroll includes a second circular end plate from which a second spiral wrap extends, and is operatively connected to a driving machanism to effect orbital motion thereof. The spiral wraps interfit at an angular offset of 180° and at a predetermined radial offset to create a plurality of line contacts which define at least one pair of sealed-off fluid pockets. As the orbiting scroll orbits with respect to the fixed scroll, refrigerant fluid in the pockets moves towards the center of the spiral wraps and undergoes a reduction in volume. The compressor fluid is discharged into a discharge chamber through a discharge hole disposed through the circular end plate of the fixed scroll and then into an external cooling circuit.

With reference to FIGS. 1 and 2, a portion of the scroll type refrigerant compressor of the '724 patent, in particular, the positioning of the fixed scroll within the compressor housing, is shown Compressor housing 10' includes cup-shaped casing 11' in which fixed scroll 20 and an orbiting scroll (not shown) are disposed. Fixed scroll 20 includes circular end plate 21 and spiral element or wrap 22 axially projecting from one axial end (forward) surface of circular end plate 21. Circular groove 200 is formed in the circumferential surface of circular end plate 21 and O-ring seal element 201 is disposed within circular groove 200. Circular end plate 21 partitions the interior space of housing 10' into front chamber 40 (to the left in FIG. 1) and rear chamber 50. Front chamber 40 is a suction chamber, and rear chamber 50 is a discharge chamber and the two chambers are isolated by O-ring seal element 201.

A plurality of supporting portions 110 project axially from the interior surface of the closed (right) end surface of cup-shaped casing 11'. (The open (left) end of casing 11' is enclosed by a front end plate, not shown). Supporting portions 110 are disposed concentrically with peripheral wall 115' of casing 11', about longitudinal axis X of cup-shaped casing 11'. A plurality of corresponding axial projections 23 extend from the rear axial end surface of circular end plate 21 of fixed scroll 20, that is, the surface opposite spiral element 22. Axial projections 23 are disposed so as to be adjacent supporting portions 110 when fixed scroll 20 is in position within casing 11', and include screw-threaded holes disposed therein. Corresponding holes are disposed through supporting portions 110, and the closed end of cup-shaped casing 11'. A plurality of screw-threaded bolts 111 extend through the closed end and through supporting portions 110, and are screwed into respective axial projections 23 to firmly secure fixed scroll 20 to the closed end surface of cup-shaped casing 11'.

With further reference to FIG. 2, the forces acting on fixed scroll 20 are shown. In general, a reaction force acts on fixed scroll 20 along the entire axial length of spiral wrap 22, form the forward axial surface to circular end plate 21. This force is caused by the compression of refrigerant gas in the fluid pockets as the pocket sizes decrease in volume during operation of the compressor. Although the force acts along the entire length of spiral wrap 22, it may be represented by vector F which is perpendicular to the longitudinal axis X, and is shown as acting at a single point along the length. Although vector F is shown as acting vertically and within the plane of the page, the actual acting direction of force vector F in fact depends upon the relative position of the wrap of the orbiting scroll with respect to the wrap of the fixed scroll during orbital motion of the orbiting scroll. Thus although representative force vector F is always essentially normal to longitudinal axis X, the tip of the force vector F, that is, the representative acting point of the force, rotates along a circular path about longitudinal axis X in accordance with the orbital motion of the orbiting scroll.

When the direction of force vector F is as shown in FIG. 2, an upward force acts on fixed scroll 20 tending to cause it to rotate in a clockwise direction as shown in the Figure, that is, about an axis perpendicular to the page. However, when orbiting scroll 20 is in an opposite orbiting positioning, force vector F acts in a downward direction and tends to cause fixed scroll 20 to rotate in a counterclockwise direction. Accordingly fixed scroll 20 would tend to nutate with respect to longitudinal axis X. However, nutational motion of fixed scroll 20 is prevented due to the contact between axial projections 23 and supporting portions 110 resulting in reaction force W'. Reaction force W' acts in a direction generally parallel to longitundinal axis X, at the contact surfaces of axial projections 23 and supporting portions 110, in turn as the orbiting scroll orbits with respect to fixed scroll 20. Reaction force W' creates a periodic stress which causes metal fatigue of cup-shaped casing 11', particularly at portions 112 located at the closed end and near peripheral walls 115' of cup-shaped casing 11'. Although the stress occurs along the entire axial mating surface between projections 23 and portions 110, force may be represented by stress vector W', perpendicular to the mating surface and acting at a central point. Thus, eventually cup-shaped casing 11' may be damaged due to the periodic application of stress (reaction) force W'.

Point O' is located at the intersection between longitudinal axis X, and a line extended from the mating axial end surfaces of supporting portions 110 and projections 23. Since during operation of the compressor, fixed scroll 20 does not move, the sum of the torques acting on fixed scroll 20 must equal zero. This moment about point O' can be represented as follows:

$$W' \times l_{2'} = F \times l_{1'} \quad (1).$$

In equation (1), $l_{1'}$ is the distance from point O' to the representative acting point of force F along longitudinal axis X, and $l_{2'}$ is the distance from point O' to the representative acting point of stress W' along the extending line. Since the representative force vectors F and W' act at a point either along axis X, or along a line perpendicular to axis X and including origin point O', equation (1) can be simplified as follows:

$$W' = l_1' F / l_2' \quad (2).$$

Additionally, during operation of the scroll type refrigerant compressor described above, as liquified refrigerant fluid is taken into the outer fluid pockets formed between the spiral elements of the fixed and orbiting scrolls and is then compressed, a force is created which tends to bend the radially outer portion of circular end plate 21 of fixed scroll 20 towards the closed end of cup-shaped casing 11', that is, towards the right in FIGS. 1 and 2. The bending of circular end plates 21 creates unacceptable gaps between the axial end surfaces of the radially outer portions of the spiral element of the orbiting scroll, and the opposing forward axial end surfaces of circular end plate 21 of fixed scroll 20 at the corresponding radially outer locations. Therefore an incomplete seal is created between the fixed and orbiting scrolls at the location of the outer fluid pockets and the efficiency of compressor operation is reduced.

Furthermore, the temperature at the central portion of the scroll greatly increases during compressor operation in comparison with the temperature increase at the radially outer portions of the scroll, due to the high compression of the refrigerant fluid in the central fluid pocket. The increased temperature at the central portion results in a large thermal expansion of the central portion of the scroll. Accordingly, even though during assembly of the compressor adequate clearance is left between the axial end surface of the spiral element of one scroll and the axial surface of the circular end plate of the other scroll, the thermal expansion of the central portions results in excessive frictional contact between the spiral elements and the central portions of the circular end plates, for both axial contact surfaces. The excessive friction results in damage to the compressor, for example, excessive wearing of the axial end surfaces of the spiral elements and the circular end plates. Additionally, the generated heat may be enough to cause the opposing surfaces to melt during operation, and to become fixed to each other after cooling.

SUMMARY OF THE INVENTION

It is an object of the present invention to provide a scroll type refrigerant fluid compressor in which metal fatiguing of the housing is prevented.

It is another object of this invention to provide a scroll type refrigerant fluid compressor in which defects in the sealing between the axial end surface of the spiral element of the orbiting scroll and the axial surface of the circular end plate of the fixed scroll are substantially eliminated.

It is another object of the present invention to provide a scroll type refrigerant fluid compressor which has a housing of reduced thickness.

It is another object of the present invention to provide a scroll type refrigerant fluid compressor in which damage to the compressor due to excessive frictional contact between the scrolls at the location of the central fluid pocket is substantially eliminated.

A scroll type refrigerant fluid compressor according to the present invention includes a compressor housing comprising a cup-shaped casing with a closed end and an open end. A front end plate is disposed over the open end of the casing to enclose the compressor housing. A fixed scroll is fixedly disposed within the housing and includes a first circular end plate from which a first spiral wrap extends. An orbiting scroll includes a second circular end plate from which a second spiral wrap extends. The first and second spiral wraps interfit at an angular offset of 180° and in a predetermined radial offset to form a plurality of line contacts which define at least one pair of sealed-off fluid pockets therebetween. A driving mechanism is operatively connected to the orbiting scroll to effect the orbital motion thereof. In operation as the orbiting scroll orbits, the line contacts shift towards the center portion of the wraps, thereby decreasing the volume of the fluid pockets. Refrigerant fluid is introduced at the outer fluid pockets, and is moved toward the central fluid pocket as the orbiting scroll orbits, to effect compression of the refrigerant fluid.

The housing includes a first supporting element comprising a plurality of supporting portions projecting inwardly from the closed end of the housing. The fixed scroll includes projections extending axially from the rear surface of the first circular end plate. The projections and annular portion are disposed concentrically with the peripheral wall of the casing, about the longitudinal axis of the casing. The first circular end plate is secured to the casing at the contact surfaces between the projections and the supporting portion by a plurality of threaded bolts disposed through the casing, and into screw-threaded bores disposed in the projections. The casing also includes a second supporting element which comprises an annular ridge projecting inwardly from the peripheral wall of the casing. The second supporting element supports the first circular end plate at a radially outer location of the rear axial surface.

Further object, features, and other aspects of this invention will be understood from the following detailed desciption of the preferred embodiments of this invention with reference to the attached figures.

DETAILED DESCRIPTION OF THE PREFERRED EMBODIMENTS

Figure 1:
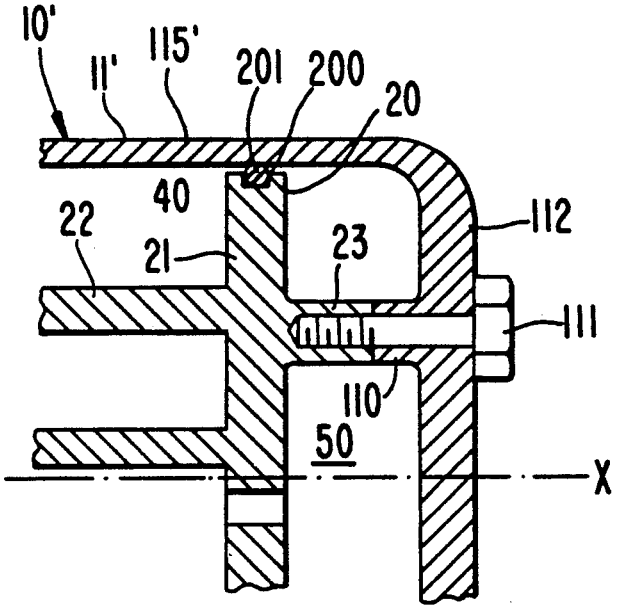
FIG. 1 PRIOR ART
FIG. 1 is a fragmentary vertical sectional view of a scroll type refrigerant compressor in accordance with the prior art showing a part of the compressor housing and a part of the fixed scroll.
Figure 3:
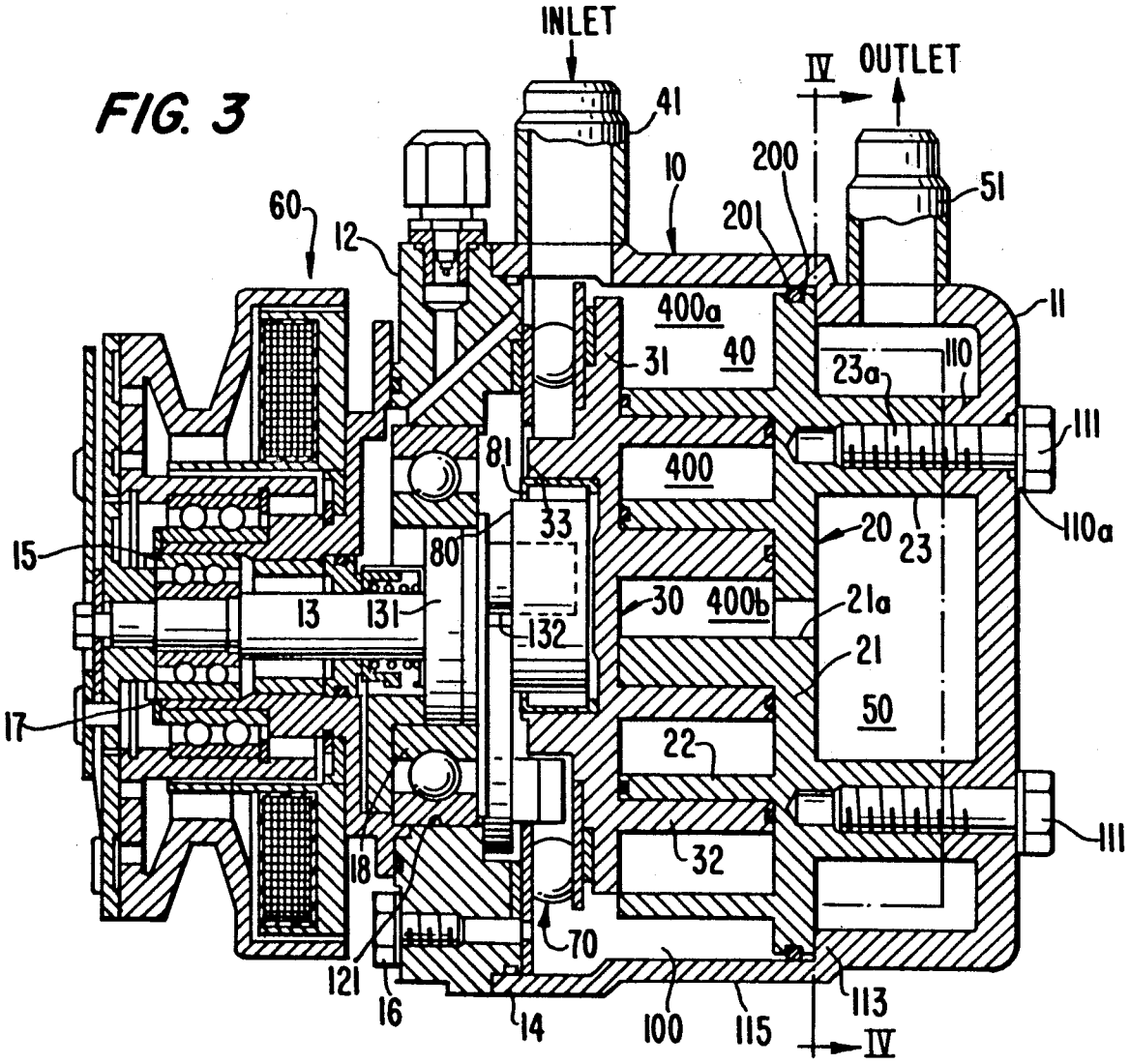
FIG. 3 is a vertical longitudinal sectional view of the scroll type refrigerant compressor in accordance with a first embodiment of the present invention.
Figure 4:
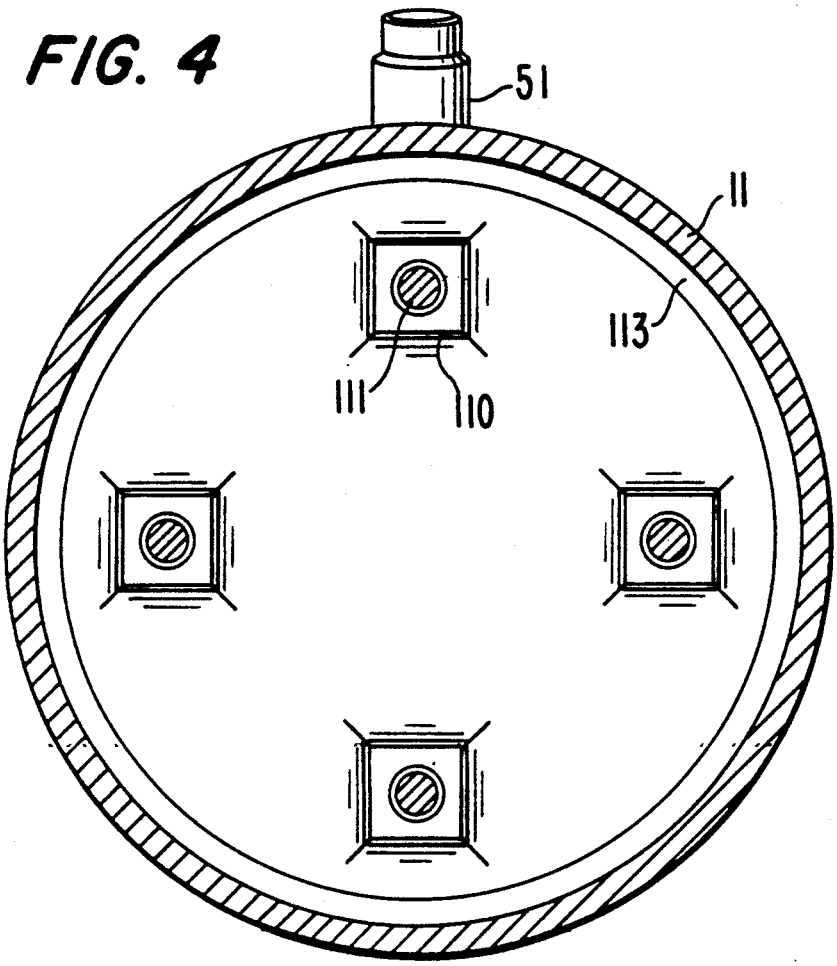
FIG. 4 is a view along line IV—IV of FIG. 3.

With reference to FIG. 3, a scroll type refrigerant fluid compressor in accordance with a first embodiment of the present invention is shown. In FIGS. 3–8, the same reference numerals are used to denote identical elements of the compressor shown in the prior art of FIG. 1. Similarly, identical though unprimed reference numerals will be used to denote elements of the compressor of FIG. 3 which are similar to elements shown in the prior art of FIG. 1. Additionally, the right side of FIG. 3 will be references as the rearward end or closed end of the compressor, and the left side of the figure will be referenced as the forward or open end of the compressor which is enclosed by the front end plate. This latter reference notation is for the sake of convenience of description only, and does not limit the scope of the invention in any way.

The compressor of the present invention includes compressor housing 10 further including cup-shaped casing 11 which is open at its forward end and closed at its rearward end. Compressor housing 10 further includes front end plate 12 disposed on cup-shaped casing 11 at its forward end, to enclose interior chamber 100. Front end plate 12 is secured to cup-shaped casing 11 by a plurality of peripherally disposed bolts 16. The mating surface between front end plate 12 and cup-shaped casing 11 is sealed by O-ring 14. Inlet port 14 and outlet port 51 are formed through the exterior surface of peripheral wall 115 of cup-shaped casing 11, adjacent suction chamber 40 and discharge chamber 50, respectively.

Opening 121 is centrally formed through front end plate 12. Sleeve 15 projects axially forward from the front surface of front end plate 12 and is disposed concentrically about the longitudinal axis of compressor 10. Drive shaft 13 is disposed through the opening in sleeve 15, and through opening 121 of front end plate 12. Bearing 17 is peripherally disposed within the forward end of sleeve 15, and rotatably supports the forward end of drive shaft 13. At its opposite or inner end, drive shaft 13 includes disk-shaped rotor 131 which rotates with drive shaft 13 and may be integrally formed therewith. Rotor 131 is rotatably supported within opening 121 of front end plate 12 by peripherally disposed bearing 18. Drive pin 132 projects rearwardly from the inner axial end surface of disk-shaped rotor 131, at a position offset from the longitudinal axis of drive shaft 13. When drive shaft 13 rotates, pin 132 orbits about the longitudinal axis of drive shaft 13. Power for rotating drive shaft 13 is transferred from an external power source (not shown) to drive shaft 13 via electromagnetic clutch 60 which is disposed about the exterior surface of sleeve 15.

Inner chamber 100 is formed within cup-shaped casing 11, and is enclosed by front end plate 12. Fixed scroll 20 is fixedly disposed within inner chamber 100, and includes circular end plate 21, and spiral element or wrap 22 integrally formed therwith and extending axially from the forward axial end surface of circular end plate 21. Circular end plate 21 divides inner chamber 100 into suction chamber 40 located forward of circular end plate 21, and discharge chamber 50 located to the rear of circular end plate 21.

Circular end plate 21 includes circular groove 200 formed in the circumferential surface thereof, and seal ring 201 is disposed in groove 200 to seal the region between the peripheral surface of circular end plate 21, and the inner surface of peripheral wall 115 of cup-shaped casing 11, to effectively isolate discharge chamber 50 from suction chamber 40. Hole or discharge port **21*a* is formed through circular end plate 21 at a central location, that is, at a position near the center of spiral element 22. Hole 21*a* links central fluid pocket 400*b* (discussed below) to discharge chamber 50**.

Orbiting scroll 30 is disposed in suction chamber 40, and includes circular end plate 31 and spiral element or wrap 32 integrally formed therewith and extending from the rear axial end surface of circular end plate 31. Spiral element 32 of orbiting scroll 30 interfits with spiral element 22 of fixed scroll 20 at an angular offset of 180°, and at a predetermined radial offset to form at least one pair of sealed-off fluid pockets 400 therebetween. Conventional rotation preventing/thrust bearing device 70 is disposed within inner chamber 100 and prevents orbiting scroll 30 from undergoing rotation when drive shaft 13 rotates.

Orbiting scroll 30 further includes boss 33 projecting axially from the forward axial end surface of circular end plate 31 at a central location, opposite spiral element 32. Bushing 80 includes a hole formed therein and is rotatably supported on projecting drive pin 132 of drive shaft 13. When drive shaft 13 rotates, bushing 80 orbits eccentrically with pin 132 about the longitudinal axis of drive shaft 13. Bushing 80 is disposed within bearing 81 in boss 33. Orbiting scroll 30 is supported on bushing 80 through boss 33 and bearing 81 such that bushing 80 may rotate with respect to orbiting scroll 30. Thus, orbiting scroll 30 is ultimately supported on drive pin 132 by bushing 80. When drive shaft 13 rotates, drive pin 132 both rotates with respect to its longitudinal axis, and orbits about the longitudinal axis of drive shaft 13. Bushing 80 orbits with drive pin 132 about the longitudinal axis of drive shaft 13, causing orbiting scroll 30 to undergo orbital motion with respect to the longitudinal axis of drive shaft 13. Although bushing 80 may rotate within boss 33, rotation of orbiting scroll 30 is prevented by rotation preventing mechanism 70.

With further reference to FIGS. 3–6, fixed scroll 20 further includes a plurality of axial projections 23 extending from the rear axial surface of circular end plate 21, opposite spiral element 22. Projections 23 include internally threaded bores **23*a*. Projections 23 are disposed in a generally circular configuration about the longitudinal axis of casing 11, so as to be intermediately disposed between the axis and peripheral wall 115 of casing 11. Casing 11 further includes a plurality of supporting portions 110 projecting axially from the interior surface of the right end surface of cup-shaped casing 11. Supporting portions 110 are disposed concentrically with peripheral wall 115 of casing 11, about longitudinal axis X of cup-shaped casing 11. holes 110*a* are disposed through supporting portions 110 at positions corresponding to threaded bores 23*a* disposed through axial projections 23. In the alternative, casing 11 may include a single annular supporting portion 110 projecting forwardly from the closed end of casing 11, and disposed about the longitudinal axis of casing 11 at a location corresponding to axial projections 23 of circular end plate 21. Annular supporting portion 110 would include a single gap therein to link the inner and outer regions of discharge chamber 50**.

Fixed scroll 20 is secured to cup-shaped casing 11 by a plurality of bolts 111 which penetrate holes **110*a* through the closed end of casing 11 and supporting portion 110, and are screwed into threaded bores 23*a* of axial projections 23. Furthermore, casing 11 further includes annular ridge 113 which projects inwardly from peripheral wall 115 of casing 11, at a location between the closed and open ends of casing 11. As discussed below, when fixed scroll 20 is fixedly secured to cup-shaped casing 11 by bolts 111, the radially outer rear axial end surface of cicular end plate 21 is securely seated on the forward axial surface of annular ridge 113**.

In operation, rotation of drive shaft 13 causes corresponding orbital motion of orbiting scroll 30 about the longitudinal axis of drive shaft 13. The plurality of line contacts formed between spiral elements 22 and 32 shift towards the center of the spiral elements. The fluid pockets defined by the line contacts between spiral elements 22 and 32 also moves towards the center of the spiral elements, and undergo a corresponding reduction in volume. Therefore, fluid or refrigerant gas introduced into suction chamber 40 from an external refrigerating circuit through inlet port 41, is taken into outer fluid pocket 400*a* and is compressed inwardly towards central fluid pocket 400*b* of spiral elements 22 and 32. The compressed fluid is discharged into discharge chamber 50 through hole 21*a*. The compressed fluid is further discharged to the external fluid circuit from discharge chamber 50 through outlet port 51.

Figure 5:
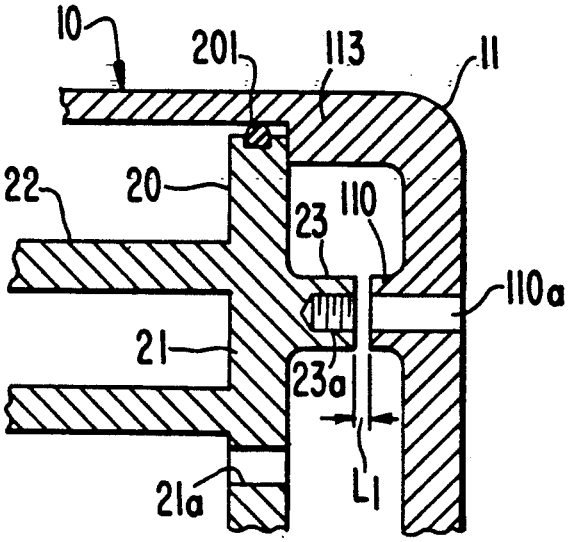
FIG. 5 is a fragmentary vertical sectional view of the scroll type refrigerant compressor shown in FIG. 3, showing the upper right corner of the compressor immediately before the fixed scroll is secured to the interior surface of the housing.
Figure 6:
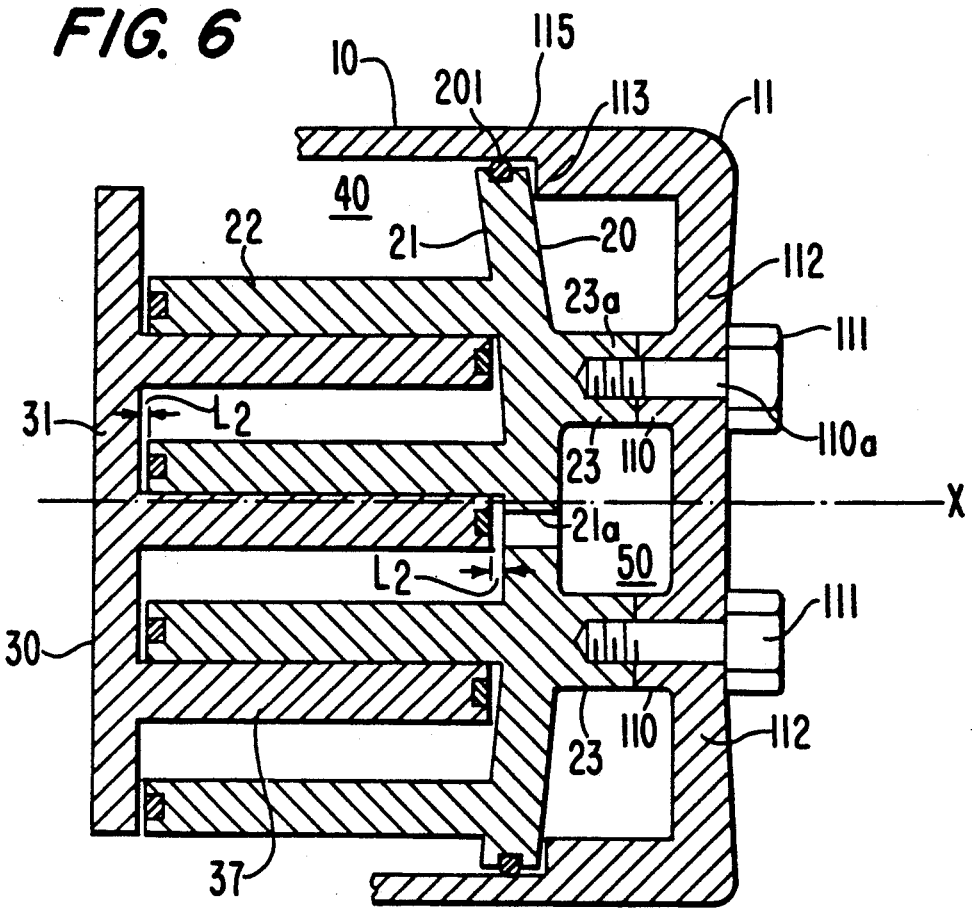
FIG. 6 is a schematic fragmentary vertical sectional view of the scroll type refrigerant compressor shown in FIG. 3, and illustrating the compressor after the fixed scroll is secured to the interior surface of the housing.
Figure 7:
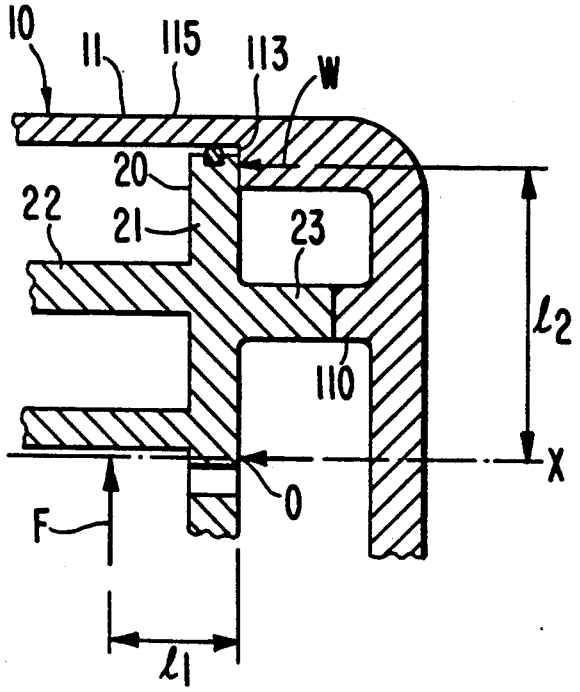
FIG. 7 is a schematic illustration of the upper right corner of the compressor shown in FIG. 3, showing the moment acting on the fixed scroll.

With reference to FIGS. 5 and 6, the configuration of the scroll type fluid compressor according to the present invention both before and after final assembly, respectively, is shown. In FIG. 5, before fixed scroll 20 is firmly secured to the closed surface of cup-shaped casing 11, when the radially outer, rear axial surface of circular end plate 21 abuts annular ridge 113, gap $L_1$ remains between the rear axial surfaces of projections 23, and the forward axial surface of supporting portion 110. Bolts 111 are then inserted through holes 110*a*, and into threaded bores 23*a* of projections 23. Bolts 111 are tightened until the heads of bolts 111 abut against the outer surface of casing 11, causing the rear axial surfaces of projections 23 to be drawn towards the forward axial surface of supporting portion 110, to thereby securely fix scroll 20 within casing 11 and simultaneously eliminate gap $L_1$.

As shown in FIG. 6, after tightening of bolts 111, a corresponding forward bending of circular end plate 21 also occurs, and an axial gap $L_2$ generally corresponding to gap $L_1$ is created between the rear axial end surface of spiral element 32 of orbiting scroll 30 at a central location thereof, and the forward axial surface of circular end plate 21 of fixed scroll 20 at a central location thereof as well. Since the closed end of casing 11 is also slightly bent to the left during tightening of bolts 111, $L_2$ is slightly smaller than $l_1$. A corresponding gap $L_2$ is also created between the central forward axial surface of spiral element 22 and the central rear axial surface of circular end plate 31. As an example only, the axial dimensions of projections 23 and supporting portion 110 may be determined so as to create an axial gap $L_2$ of 0.05 millimeters. As the compressor is operated, axial gap $L_2$ compensates for the thermal expansion of the central portion of scrolls 20 and 30 to maintain the axial sealing between the axial ends of the spiral elements and the respective circular end plates, while eliminating excessive friction therebetween. Thus, damage to the scrolls due to the heat generated by friction is eliminated With further reference to FIGS. 2 and 7, an advantage of providing annular ridge 113 to support the radially outer portions of fixed scroll 20 is shown. As in the prior art, fixed scroll 20 tends to nutate about longitudinal axis X due to the force F of the compressed gas in the fluid pockets. However, fixed scroll 20 does not nutate due to a reaction force provided by cup-shaped casing 11. However, the primary reaction force is shown as force vector W located at the position of contact vetween the radially outer , rear axial surface of circular end plate 21 and annular ridge 113, and not at the contacting surfaces of projections 23 and portion 110. Thus, in the present invention, stress force W' on cup-shaped casing 11 is significantly reduced, and the primary stress force is shifted to the contact surface between the forward axial surface of annular rigde 113, and the radially outer, rear axial surface of circular end plate 21, that is, at the tip of representative vector W acting at a representative point along the contact surface. Of course, stress W is only periodically generated on any particular representative point due to the obital motion of orbiting scroll 30 and corresponding movement of force F with respect to longitudinal axis X.

The moment on fixed scroll 20 may be calculated with respect to point O which is at the intersection between longitudinal axis X, and an extended line (not shown) which includes the forward surface of annular ridge 113 and whih is perpendicular to longitudinal axis X. The moment can be calculated as follows:

$$W \times l_2 = F \times l_1 \quad (3).$$

In the above equation, $l_1$ is the distance from origin point O to the representative acting point of reaction force F along longitudinal axis X, and $l_2$ is the distance from point O to the representative acting point of stress along the extended line which is perpendicular to longitudianl axis X. Therefore, in order to determine the magnitude of stress W, the above equation may be simplified as follows:

$$W = F\, l_1 / l_2 \quad (4).$$

Figure 2:
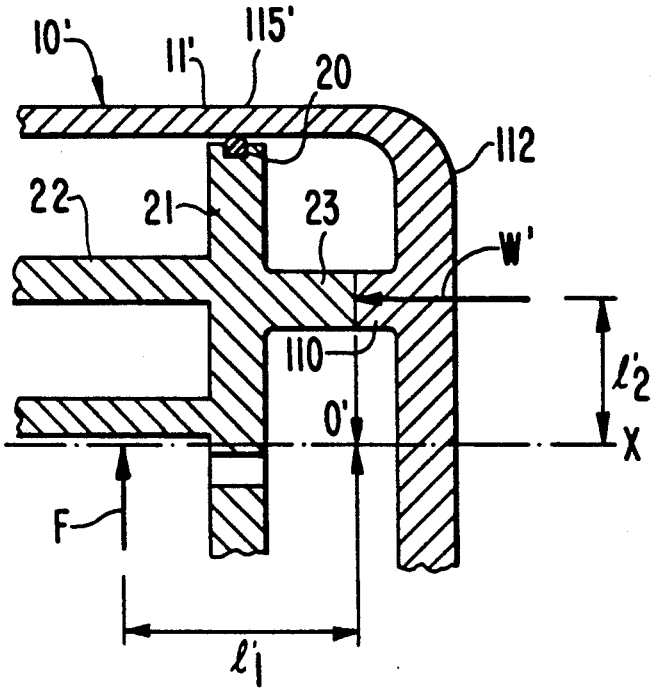
FIG. 2 PRIOR ART
FIG. 2 is a schematic illustration showing the moment acting on the fixed scroll shown in the prior art of FIG. 1.

With further reference to FIG. 2 and equations (1) and (2), a comparison between stress W at annular ridge 113 of the present invention and stress W' of the prior art may be made. Assuming force F to be equal in both cases, stresses W and W' depend upon the relationship between the distances $l_1$ and $l_2$, and $l_{1'}$ and $l_{2'}$. Since it is clear that the distance $l_2$ between longitudinal axis X and the location of annular ridge 113 is greater than the distance $l_{2'}$ between longitudinal axis X and the central location of projections 23', and furthermore since distance $l_1$ between the origin point O and the location of reaction force F is less than the distance $l_{1'}$ which is the distance between origin point O' and reaction force F, it is clear that stress W is smaller than stress W'. Since the stress is responsible for metal fatigue on cup-shaped casing 11, it is clear that the metal fatigue is reduced in the present invention by disposing the radially outer, rear axial surface of fixed scroll 20 in contact with annular ridge 113. This result is obtained both due to moving the primary contact surfaces further away from axis X, and due to dividing the contact between two distinct surfaces. Since the metal fatigue is reduced by the present invention, the thickness of cup-shaped casing 11 may also be substantially reduced over the prior art. As a result, the size and weight of the compressor housing can be reduced.

Figure 8:
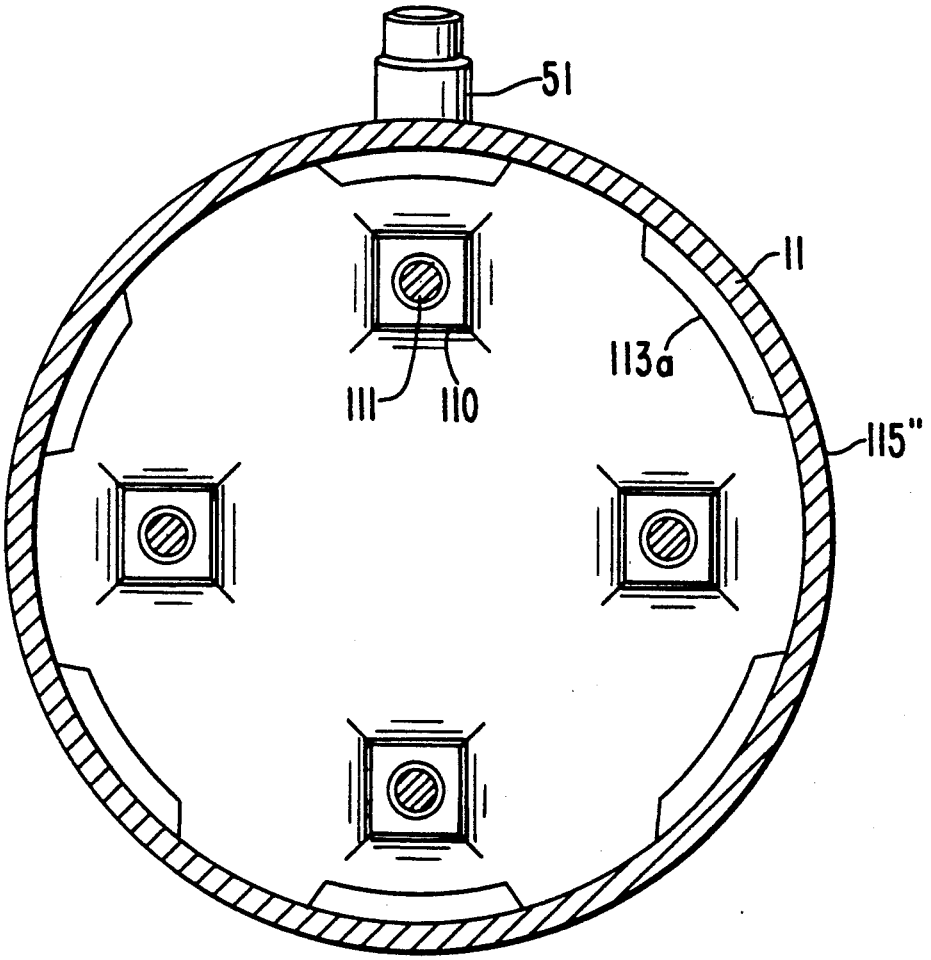
FIG. 8 is a view similar to the view shown along line IV—IV of FIG. 4, and in accordance with a second embodiment of the present invention.

Additionally, since circular end plate 21 of fixed scroll 20 is supported at its radially outer, axial end surface, the bending of circular end plate 21 towards the closed cup-shaped casing 11 due to the compression of the liquified refrigerant in the outer pockets of the scrolls is substantially reduced. As a result, the seal between the axial end surface of the spiral element of the orbiting scroll and the circular end plate of the fixed scroll, at the outer locations of the scrolls is maintained to a higher degree than in the prior art, thus eliminating the undesired reduction in the efficiency of the compressor A second embodiment of the present invention is shown in FIG. 8. In the second embodiment, a plurality of arcuate ridges 113*a*, preferably three or more, are formed at the inner surface of wall 115" of cup-shaped casing 11. The plurality of arcuate ridges 113*a* provide substantial support to the radially outer, rear axial surface of fixed end plate 20 as in the first embodiment to reduce the stress on cup-shaped casing 11, and increase the efficiency of the compressor. Since all other aspects of the second embodiment are identical to the first embodiment, further explanation of the second embodiment is omitted.

This invention has been described in detail with respect to the preferred embodiments. These embodiments, however, merely are for example only and this invention is not restricted thereto. It will be easily understood by those skilled in the art that variations and modifications can be easily made within the scope of the invention, as defined by the appended claims.

I claim:

1. A scroll type fluid compressor comprising:

a compressor housing including a casing enclosed at one end, and a front end plate disposed on an opposite open end of said casing to enclose an interior chamber therein;

a fixed scroll fixedly disposed within said housing, said fixed scroll including a first circular end plate having an axial end surface from which a first spiral wrap extends;

an orbiting scroll disposed within said housing, said orbiting scroll including a second circular end plate from which a second spiral wrap extends, said first and second spiral wraps interfitting at an angular and radial offset to form a plurality of line contacts defining at least one pair of sealed-off fluid pockets, said first and second spiral wraps having a uniform height;

driving means operatively connected to said orbiting scroll for effecting the orbiting motion of said orbiting scroll to thereby change the volume of the fluid pockets; and an axial gap maintained between the axial end surface of the spiral wrap of each scroll and the adjacent axial surface of the circular end plate of the other of said scroll, said axial gap being larger at a radially central region of said scroll.

2. The scroll type fluid compressor recited in claim 1 further comprising a peripheral supporting means for supporting said first circular end plate within said housing at a radially outer portion of said first circular end plate.

3. In a scroll type fluid compressor, said compressor including an enclosed housing, a fixed scroll fixedly disposed within said housing and having a first circular end plate from which a first spiral wrap extends, an orbiting scroll having a second circular end plate from which a second spiral wrap extends, said first and second spiral wraps interfitting at an angular and radial offset to form a plurality of line contacts defining at least one pair of sealed-off fluid pockets, a drive means operatively connected to said orbiting scroll for effective orbital motion of said orbiting scroll to thereby change the volume of said at least one pair of fluid pockets, a rotation preventing means for preventing the rotation of said orbiting scroll during orbital motion, a first supporting means disposed in said housing for supporting said first circular end plate at a radially intermediate position, fastening means for fastening said first circular end plate to said first support means, the improvement comprising:

a second supporting means disposed in said housing for supporting said first circular end plate at a radially outer position, said housing comprising a cup-shaped casing having a peripheral wall, said second supporting means comprising an annular ridge formed at an inner surface of the peripheral wall of said casing, said annular ridge contacting and supporting a radially outer, axial surface of said first circular end plate on one end of said first circular end plate.

said fastening means drawing said first circular end plate towards said housing at the location of said first supporting means and thereby forcing said first circular end plate into contact with said annular ridge at the radially outer position, the contact causing said first circular end plate to be slightly bent towards said second circular end plate at the radially outer position.

4. A scroll type fluid compressor comprising:

a compressor housing including a casing enclosed at one end, and a front end plate disposed on an opposite end of said casing to enclose an interior chamber therein;

a fixed scroll fixedly disposed within said housing, said fixed scroll including a first circular end plate having an axial end surface from which a first spiral wrap extends;

an orbiting scroll disposed within said housing, said orbiting scroll including a second circular end plate from which a second spiral wrap extends, said first and second spiral wraps interfitting at an angular and radial offset to form a plurality of line contacts defining at least one pair of sealed-off fluid pockets;

driving means operatively connected to said orbiting scroll for effecting the orbital motion of said orbital scroll to thereby change the volume of the fluid pockets;

an axial gap maintained between the axial end surface of each said spiral wrap and the adjacent axial surface of said circular end plate of the other said scrolls, said axial gap formed by bending one of said end plates at a radially outer region.

5. The scroll type fluid compressor recited in claim 4, wherein, said first circular end plate is bent.

6. The scroll type fluid compressor recited in claim 5 further comprising a peripheral supporting means for supporting said first circular end plate within said housing at a radially outer portion of said first circular end plate.

7. The scroll type fluid compressor recited in claim 4, wherein, the height of said spiral wraps is uniform.

8. A scroll type fluid compressor recited in claim 4 further comprising a first supporting means disposed in said housing for supporting said first circular end plate at a radially intermediate position and a second supporting means disposed in said housing for supporting said first circular end plate at said radially outer region.

9. The scroll type fluid compressor recited in claim 8, said housing comprising a cup-shaped casing having a peripheral wall, said second supporting means comprising an annular ridge formed at an inner surface of the peripheral wall of said casing, said annular ridge contacting and supporting a radially outer, axial surface of said first circular end plate on one end of said first circular end plate.

10. The scroll type fluid compressor recited in claim 9, said first supporting means comprising a support portion extending inwardly from an axial end surface of said housing, said fixed scroll including a plurality of projections extending from the axial end surface of said first circular end plate opposite said first spiral wrap, said projections secured to said support portion by screws disposed therethrough.

11. The scroll type fluid compressor recited in claim 8, said housing comprising a cup-shaped casing having a peripheral wall, said second supporting means comprising a plurality of arcuate ridges formed at the inner surface of the peripheral wall of said housing, said annular ridges contacting and supporting a radially outer, axial surface of said first circular end plate on one side of said first circular end plate.

12. The scroll type fluid compressor recited in claim 11, said plurality of arcuate ridges including at least three ridges.

13. The scroll type fluid compressor recited in claim 4, said first circular end plate dividing an interior region of said enclosed housing into a discharge chamber and a suction chamber, said housing further comprising a fluid inlet port linked to said suction chamber and a fluid outlet port linked to said discharge chamber.

14. The compressor recited in claim 6, said casing being cup-shaped and having a peripheral wall, said peripheral supporting means comprising an annular ridge formed along an inner surface of the peripheral wall of said casing, said annular ridge contacting and supporting the radially outer, axial surface of said first circular end plate which is opposite from first spiral wrap.

15. The compressor recited in claim 14, said casing further comprising an intermediate support means for supporting said first circular end plate at a radially intermediate position, said fixed scroll fixedly attached to said casing at said intermediate support means.

16. A method for assembling a scroll type fluid compressor comprising a compressor housing including a casing enclosed at one end, and a front end plate disposed on an opposite end of said casing to enclose an interior chamber therein; said method comprising the steps of:

fixedly disposing a fixed scroll within said housing, said fixed scroll including a first circular end plate having an axial end surface from which a first spiral wrap extends;

disposing an orbiting scroll within said housing, said orbiting scroll including a second circular end plate from which a second spiral wrap extends, said first and second spiral wraps interfitting at an angular and radial offset to form a plurality of line contact defining at least one pair of sealed-off fluid pockets;

bending one of said end plates at a radially outer region to form an axial gap between the axial end surface of each said spiral wrap and the adjacent axial surface of said circular end plate of the other said scroll; and operatively connecting a driving means to said orbiting scroll to effect the orbital motion of said orbital scroll to thereby change the volume of the fluid pockets.

* * * * *